United States Patent [19]

Andrade

[11] 4,142,335

[45] Mar. 6, 1979

[54] BUILDING CONSTRUCTION

[76] Inventor: Harold H. Andrade, Box 942, Grand Cayman, Cayman Islands

[21] Appl. No.: 769,186

[22] Filed: Feb. 16, 1977

[51] Int. Cl.[2] ..... E04B 7/02

[52] U.S. Cl. ..... 52/90; 52/282

[58] Field of Search ..... 52/407, 444, 648, 91, 52/92, 348, 93, 584, 90, 282

[56] References Cited

U.S. PATENT DOCUMENTS

| | | | |
|---|---|---|---|
| 1,535,504 | 4/1925 | Stephens | 52/407 |
| 1,714,987 | 5/1929 | Pedersen | 52/584 |
| 1,884,462 | 10/1932 | Willson | 52/444 X |
| 1,958,473 | 5/1934 | Dovell | 52/648 X |
| 2,104,870 | 1/1938 | Levy | 52/91 |
| 2,104,874 | 1/1938 | Levy | 52/91 |
| 2,131,464 | 9/1938 | Estes | 52/92 |
| 2,234,960 | 3/1941 | Buelow | 52/92 |
| 2,445,491 | 7/1948 | Moloney | 52/648 |
| 3,049,200 | 8/1962 | Gordon | 52/348 |
| 3,162,278 | 12/1964 | Rasch | 52/93 |

*Primary Examiner*—John E. Murtagh

[57] ABSTRACT

A building construction comprising a self-supporting skeletal frame formed of light gauge metal structural members of a generally channel configuration which are used singly or welded back-to-back to form H assemblies for particular applications such as for intermediate wall studs, roof rafters and roof purlins. Corner wall studs are formed of a pair of welded back-to-back channels with a third channel welded along one pair of side flanges thereof. Wall sections are disposed between each adjacent pair of wall studs within the confines defined by opposed channel openings of each pair, and roof sheeting is applied atop the roof rafters and purlins. Standard ceiling tiles are supported between the roof rafters and purlins on the lower flanges thereof within the confines of the opposed channel openings.

9 Claims, 17 Drawing Figures

BUILDING CONSTRUCTION

FIELD OF THE INVENTION

The present invention pertains to a building construction and, more particularly, to a building construction utilizing a self-supporting skeletal frame formed of structural members formed of light gauge metal channel members used singly and in welded together combinations. Wall sections are disposed between various pairs of wall studs so formed, roofing is applied atop roof rafters and purlins so formed, and ceiling tiles are supported by said roof rafters and purlins.

BACKGROUND OF THE PRESENT INVENTION

There is a substantial amount of prior art pertaining to building construction, and a great portion of this art is directed to prefabricated construction in which relatively large sections and/or panels are fabricated in a factory and are transported to the construction site. Obviously, this type of prefabrication requires heavy, very costly machinery to handle the sections and panels both in the factory and at the construction site as well as for the transportation of same from the factory to the building site.

The building construction of the present invention utilizes structural members rolled or formed of a relatively light gauge metal such as galvenized steel sheets. A single basic channel form is provided for all of the main structural elements, the wall studs, roof rafters and purlins. Some structural elements are cut to size from the basic channel form and others are formed by welding two or three channels together.

All of the structural elements may be prefabricated at a factory by simply cutting the individual elements to size from the channels, by welding them together, when necessary and by welding attachment cleats and plates to the various elements for assembly purposes at the building site. Therefore, all prefabricated elements may be easily handled by one man for truck loading and unloading purposes and relatively small trucks may be employed to transport the structural members to the building site.

A generally conventional concrete slab and foundation is prepared at the building site and the wall studs are fixed thereto by conventional means such as anchor bolts and the roof rafters, purlins, etc. are bolted together and to the studs by means of the cleats to complete a self-supporting skeletal frame for the building.

Exterior wall sections are inserted or constructed between each adjacent pair of studs, roofing or roof sheeting is applied across the flush top surfaces of the roof rafters and purlins and standard ceiling tiles are supported within the undersides of the rafters and purlins. All exterior window and door opening are formed between respective pairs of exterior studs by light gauge metal members, fixed in place by attachment cleats and welding and/or bolts in the same manner as utilized to connect the studs, roof rafters and purlins.

The building construction of the present invention is adaptable to buildings of various types and sizes but is particularly desirable to provide relatively small, low cost housing for persons unable to afford to rent or purchase conventional, expensive residences, the construction cost being approximately fifty percent of conventional construction.

Therefore, one of the principal objects of the present invention is to provide structural elements formed of a light gauge sheet metal which are preformed and provided with connection means for erection at a building site to form a self-supporting skeletal building frame in a very minimal number of man hours of work.

Another principal object of the invention is to provide all of the basic structural members for the skeletal frame in a channel form which, when cut to size, may be used singly or in welded together combinations of two or more channels for the exterior wall studs, roof rafters and purlins.

A further object of the invention is to provide unreinforced concrete blocks as wall infills between each adjacent pair of wall studs or by using a dry construction sandwich paneling with an infill of expanded Polystyrene faced on both sides with asbestos cement, gypsum wallboard, metal sheets or particle board for example. A cement render may be applied to both the inside and outside surfaces of the wall infills.

Yet another object of the instant invention is to provide each adjacent pair of the roof rafters and purlins with confronting channel shaped openings whereby conventional ceiling tiles may be supported therebetween on lower flanges of the channels. Small H shaped or double channel members supported between the rafters or purlins may be used to assist in supporting the ceiling tiles where necessary.

A still further object of the present invention is to provide a cleat connection between the rafters and purlins in a manner so as to achieve a level or coplanar condition between the upper and lower surfaces of said rafters and purlins whereby a roof sheeting of any type may be attached thereatop and the ceiling tiles may be supported on the lower flanges thereof.

A further principal object of the present invention is to provide a building construction which is approximately one-half as costly as the present day conventional construction.

DETAILED DESCRIPTION OF THE DRAWINGS

Figure 1:
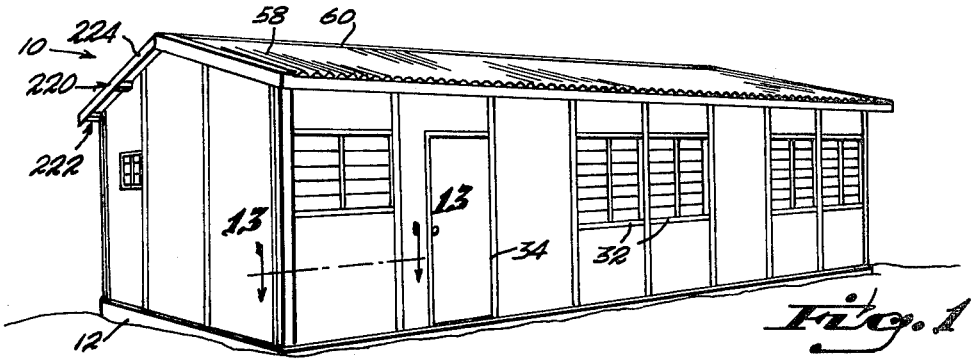
FIG. 1 is a perspective view of a building in accordance with the construction of the present invention.
Figure 2:
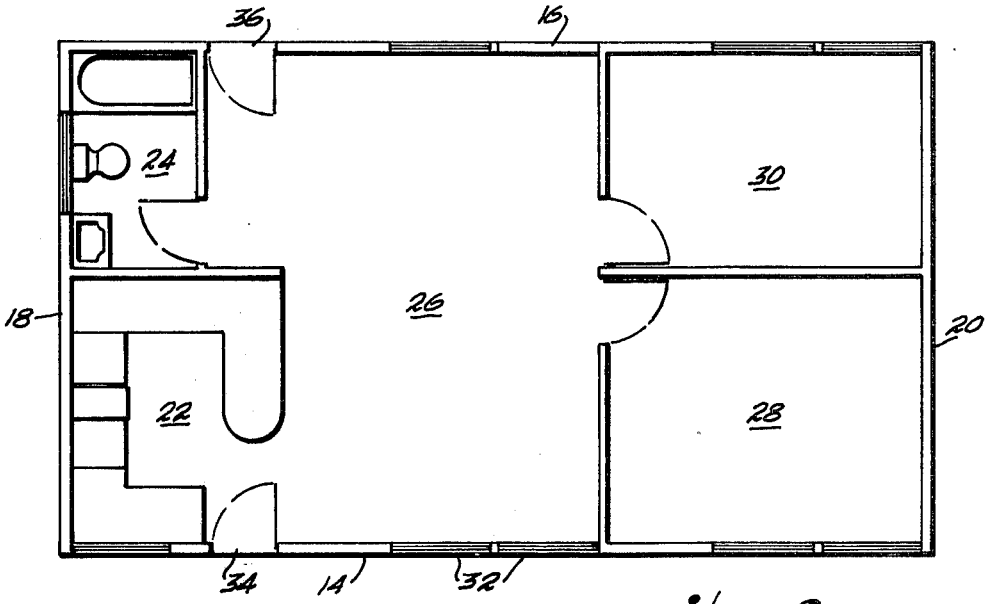
FIG. 2 is a typical floor plan of the building of FIG. 1.

With reference to the drawings in which like reference characters designate like or corresponding parts throughout the various views, and with particular reference to FIG. 1, the numeral 10 indicates generally a building, comprising a relatively small residence, constructed in accordance with the present invention. The building 10 is constructed on a steel reinforced concrete foundation and slab 12 and as seen in the floor plan, FIG. 2, includes four side walls, front wall 14, back wall 16 and opposed end walls 18 and 20. The floor plan is generally typical of a relatively small home, providing a kitchen 22, bathroom 24, a combination living and dining room 26, and two bedrooms 28 and 30.

The various rooms are provided with window openings 32 and front and rear door openings 34 and 36. As will be subsequently described in more detail, the windows 32 may be of any conventional type, jalousie windows being illustrated in FIG. 1.

Figure 3:
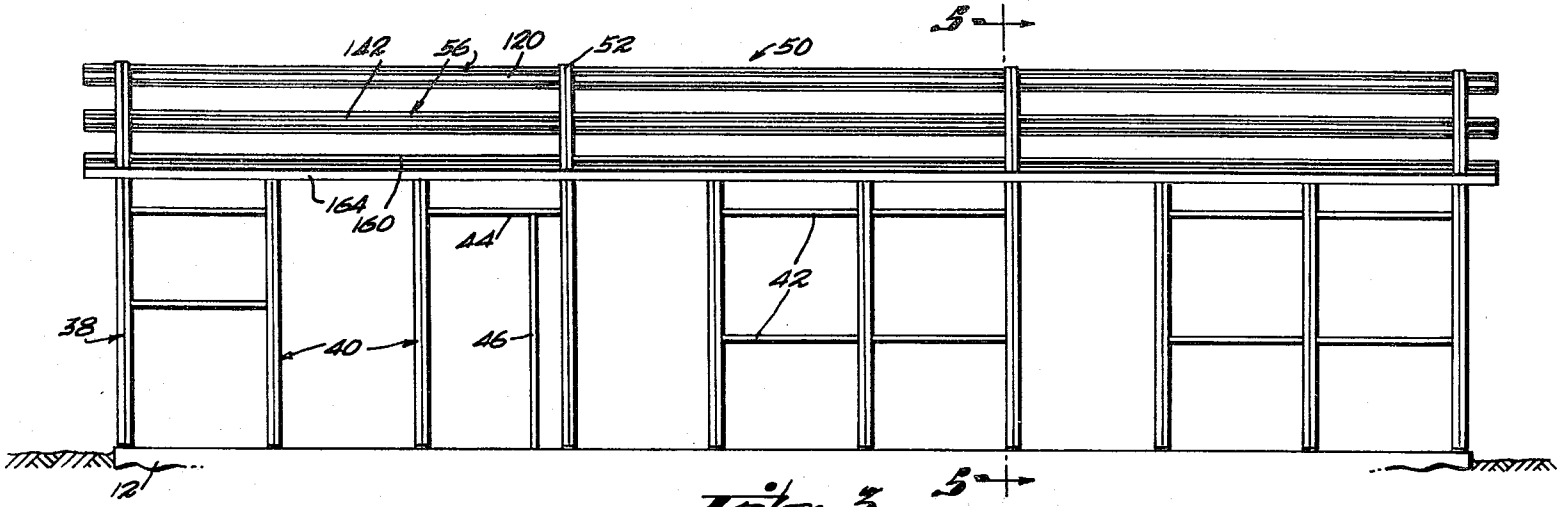
FIG. 3 is a front elevation of the skeletal frame of the building of FIG. 1.
Figure 5:
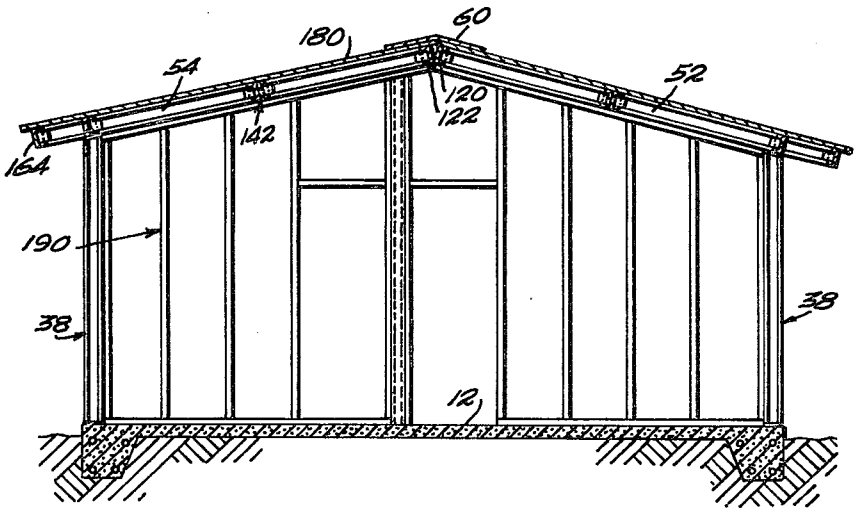
FIG. 5 is a vertical cross section taken along line 5—5 of FIG. 3.
Figure 4:
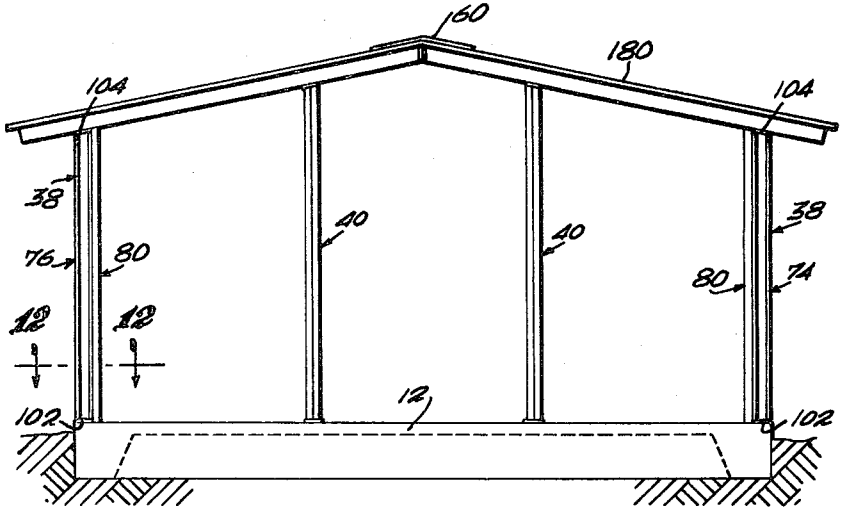
FIG. 4 is an end elevation of the skeletal frame.

Referring now to FIGS. 3, 4 and 5, the exterior wall structural members include corner studs indicated generally at 38, intermediate studs 40, transverse window frame members 42 fixed between various pairs of studs 38 and 40 to define the window locations, and a transverse top member 44 and a vertical side member 46 to define each entry door location.

A roof structure indicated generally at 50 is fixed atop the exterior walls in a covering relation to the interior of the structure and is comprised generally of a gable roof as illustrated including fixed together pairs of roof rafters 52 and 54 interconnected by a plurality of purlins indicated generally at 56. While a gable roof is illustrated in the drawing, other roof types such as a flat or shed roof may be provided without departing from the basic concept of the present invention.

A finished roof of any of a variety of types may be applied atop the rafters and purlins 52, 54 and 56. FIG. 1 illustrates a corregated sheet metal roof 58 with a ridge cap 60.

Figures 6, 8, 9, 10, 11, 12:
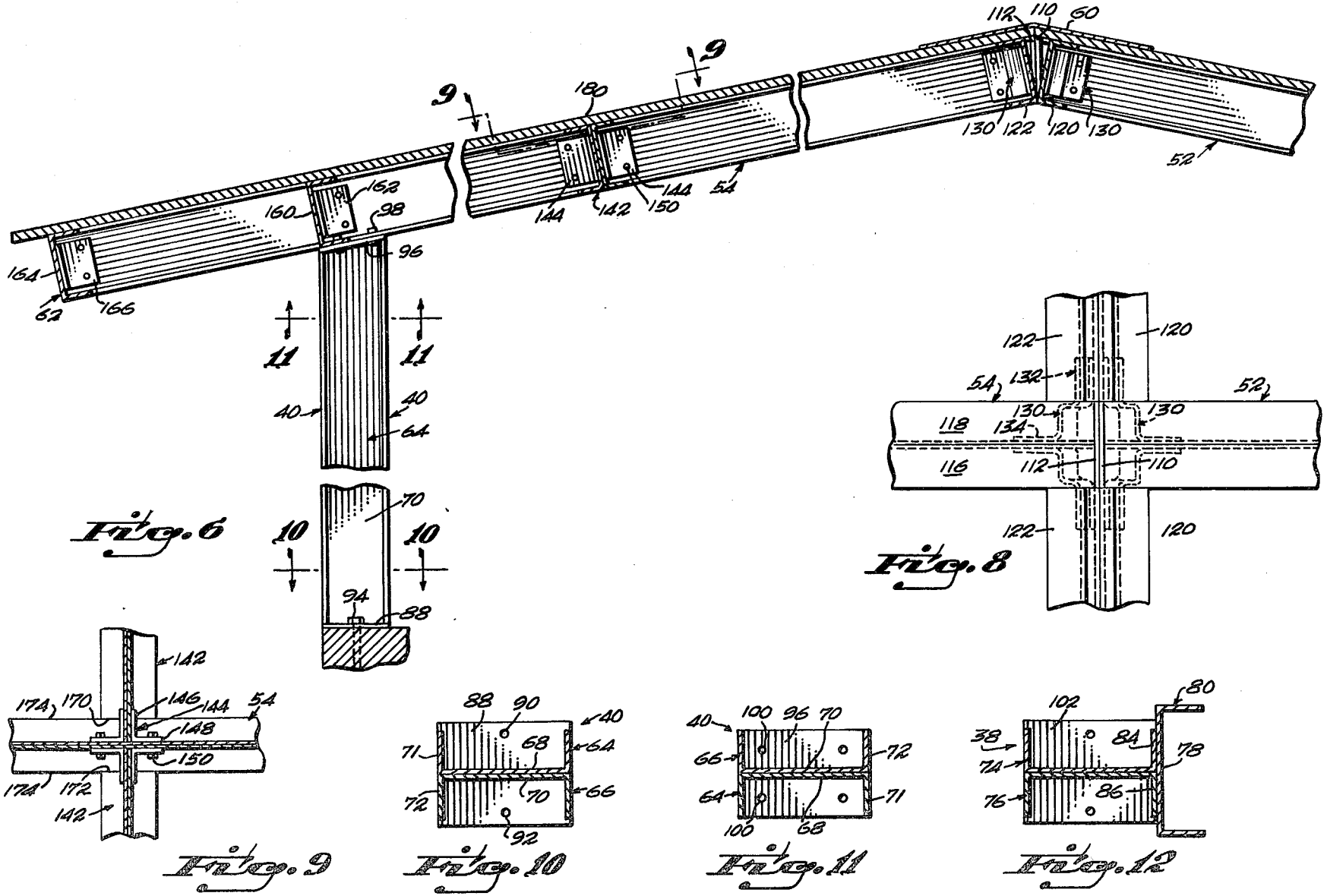
FIG. 6 is an enlarged, fragmentary, detailed view taken from FIG. 5.
FIG. 8 is a top plan view of the connection between two pairs of ridge purlins and a pair of roof rafters in accordance with FIG. 7.
FIG. 9 is a sectional view taken along line 9—9 of FIG. 6.
FIG. 10 is a cross sectional view taken along line 10—10 of FIG. 6.
FIG. 11 is a cross sectional view taken along line 11—11 of FIG. 6.
FIG. 12 is a cross sectional view taken along line 12—12 of FIG. 4.

All of the basic structural members, above described, are formed of a light gauge sheet metal such as galvanized sheet steel cut and formed into a cross sectional channel configuration as indicated generally at 62 in FIG. 6. FIGS. 10 and 11 illustrate in cross section two alike channels 64 and 66 welded together in a back-to-back relation to define an H configuration. Back webs 68, 70 of the respective channels are welded together and the side flanges thereof 71 and 72 define oppositely opening channels. The double channel assembly of FIGS. 10 and 11 comprise the intermediate studs 40.

The corner studs 38 are comprised of two channels 74 and 76 welded together in the above described manner with the back web 78 of a third channel 80 welded across side flanges 84 and 86 of channels 74, 76.

With further reference to FIGS. 6 and 10 a bottom anchor plate 88 is fixed as by welding across the bottom ends of channels 64 and 66. Holes 90 and 92 are provided in the anchor plate 88 for the reception of anchor bolts 94 preset in the slab 12 in a conventional manner. In this way, the intermediate studs 40 are fixed in vertical positions along slab 12. In like manner a top plate 96 is welded across the upper ends of intermediate stud channels 64, 66 for bolted engagement at 98 to one of the roof rafters 52 or 54, FIG. 6, by means of holes 100.

A similar anchor plate 102 as well as a top plate 104, FIGS. 4, 5 and 12, are welded across the bottom and top ends of channels 74 and 76 of each corner stud 38 for attachment to the slab 12 and roof rafters 52 and 54 in the same manner as above described relative to intermediate studs 40.

Figure 7:
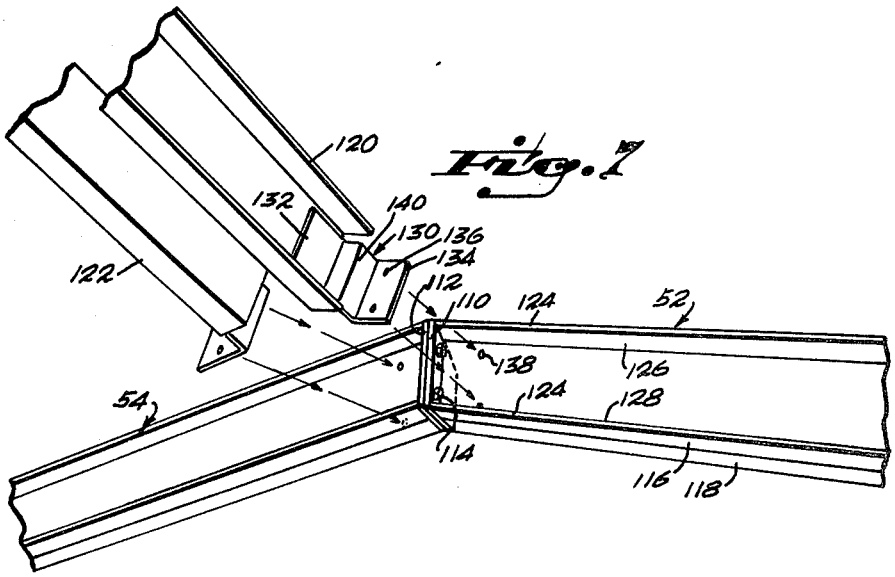
FIG. 7 is an exploded view illustrating the connection means between two ridge purlins and a pair of roof rafters.
Figure 16:
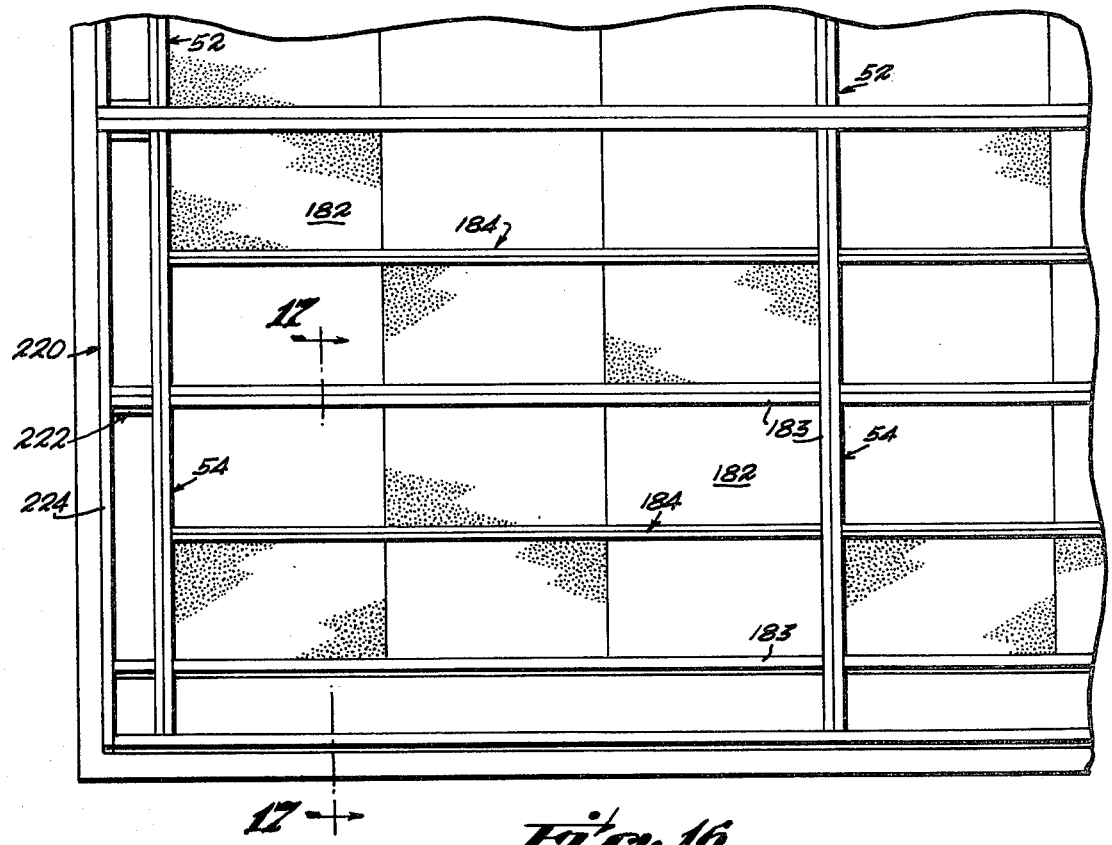
FIG. 16 is a view looking upwardly toward the ceiling of the structure, the roof being illustrated removed from the side walls.

With reference to the roof structure 50, as best illustrated in FIGS. 3 through 9, the pairs of roof rafters 52 and 54, four pairs illustrated in FIG. 3, are each provided at their confronting ends with a plate 110 and 112 welded thereto for bolted attachment at 114, FIGS. 7 and 8. The confronting ends are angled to define the pitch of the gable roof. As best seen in FIGS. 7 and 16, the roof rafters 52 and 54 are formed of pairs of channels 116 and 118 welded together back to back in the same manner as described relative to the exterior wall studs 40.

The various adjacent pairs of rafter assemblies 52 and 54 are interconnected by the purlins 56, FIG. 1. Referring now to FIGS. 6, 7 and 8, the purlins include a pair of ridge purlins 120 and 122, both of a channel configuration in cross section, fixed in spanning relation between the ridge ends of each adjacent pair of rafters 52 and 54. The ridge purlins 120 and 122 are of such lengths so as to span the distance between the outer edges 124 of the respective channel flanges 126 and 128 of each adjacent pair of rafters. A connector cleat 130 of a generally angular configuration provides a first leg 132 fixed to each end of each purlin 120 and 122 as by welding. Second leg 134 of each cleat 130 is angled at right angles to leg 132 and is provided with holes 136 for bolted connection through mating holes 138 in a rafter 52 or 54. As best illustrated in FIGS. 7 and 8, each cleat 130 is stepped outwardly and forwardly as at 140 between the angularly related legs 132 and 134 to clear the plate connection 110, 112 between rafters 52 and 54.

Intermediate purlins 142 are connected between each adjacent pair of rafter assemblies 52, 54, FIGS. 6 and 9, by angle cleats 144. A first leg 146 of each angle cleat is fixed as by welding to the end of each side of a purlin 142 and second legs 148 of the respective cleats 144 are fixed together through the rafters 52 and 54 by nuts and bolts 150. As with the wall studs 40 and rafters 52 and 54, the intermediate purlins 142 are H form in cross section, being formed of a pair of welded together sheet metal channels.

Outer purlins 160, positioned over the outer walls are formed of single inwardly opening channels and are provided with angle cleats 162 which connect between adjacent pairs of rafter assemblies 52 and 54 in the same manner as described relative to the intermediate purlins 142.

Facia channels 164 are connected between the extended ends of the eave portions of the rafters by angle brackets 166 in the same manner as above described relative to the purlins.

It should be noted that the upper and lower flanges of the channels of the intermediate and outer purlins 142 and 160 as well as the facia channels 164 are notched out as at 170, 172, illustrated in FIG. 9 relative to the intermediate purlins 142, to the outer edges 174 of the rafters 50 and 52.

Figure 17:
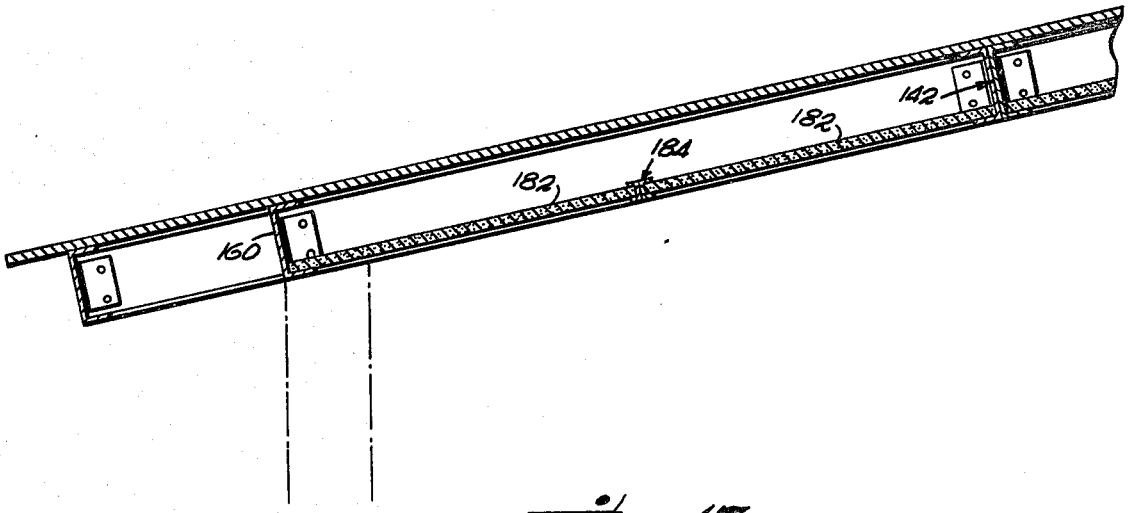
FIG. 17 is an enlarged cross sectional view taken along line 17—17 of FIG. 16.

Therefore, the upper and lower surfaces of all of the roof structural member are flush. This provides an ideal situation for applying a corregated metal roof 58 to the structure as in FIG. 1 or sheathing 180 as in FIG. 6. As illustrated in FIGS. 16 and 17 it also provides an ideal condition for suspending conventional ceiling tiles 182 on the bottom flanges 183 of the various rafters and purlins. Small intermediate H members 184, disposed longitudinally between adjacent rafters 52 and 54 are used when necessary to support confronting edges of two rows of ceiling tiles. The H members 184 are formed by welding the base webs of two small sheet metal channels together as above described. If desired the H members 184 may be disposed transversely between adjacent pairs of purlins.

The outer wall stud, roof rafter and purlin assembly as above described provides a self-supporting skeletal frame. Window and door frame members 42, 44 and 46 are preferably formed of single channels, attached in place by angle cleats as above described. Interior wall partitions such as 190, FIG. 5, are likewise constructed of sheet metal channels with attachment cleats and they may be positioned to define any desired room arrangement. Interior stud and frame members are preferably smaller in cross sectional size than the exterior structural members and the partitions formed thereby are not load bearing.

Figure 13:
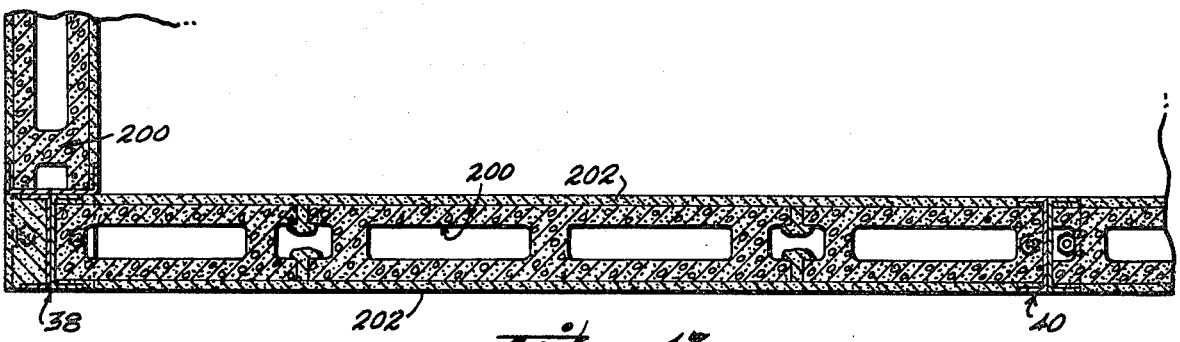
FIG. 13 is a cross sectional view taken along line 13—13 of FIG. 1 illustrating one preferred form of wall infill between two outside wall studs.
Figure 14:
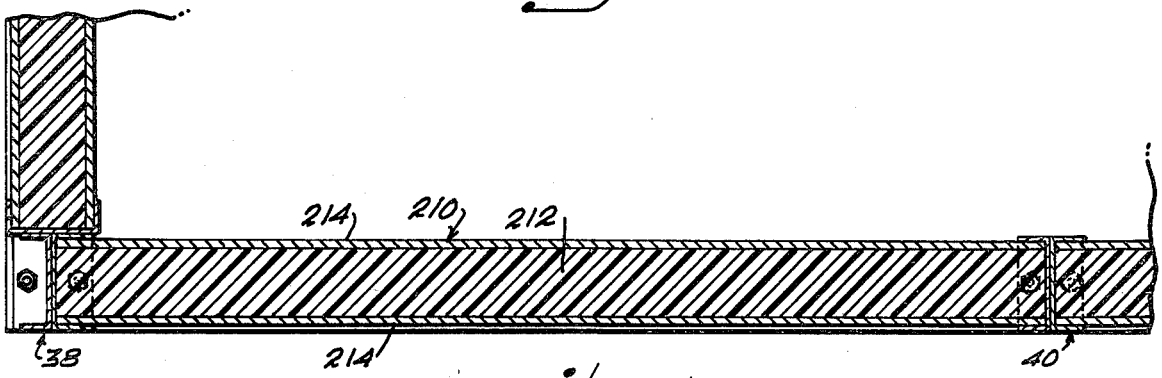
FIGS. 14 and 15 are sectional views similar to FIG. 13 illustrating two alternative wall infill constructions.
Figure 15:
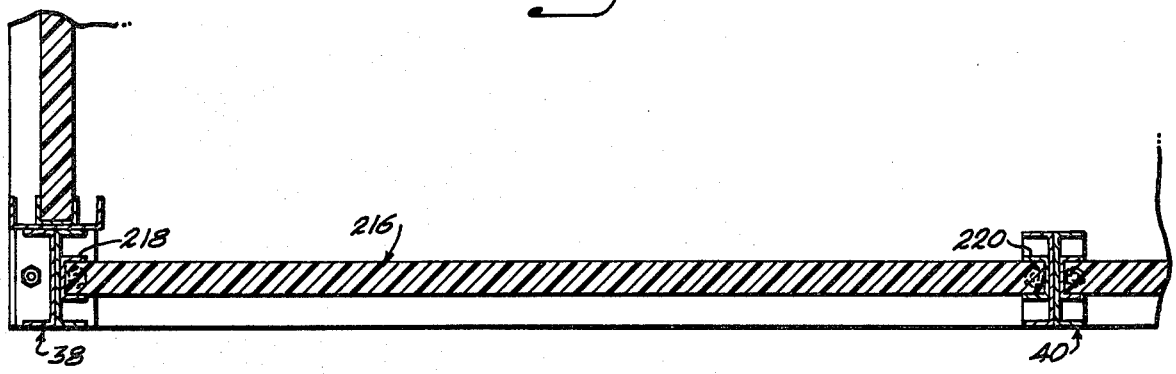

FIGS. 13, 14 and 15 illustrate some of the various types of exterior wall infills which may be provided between each adjoining pair of exterior wall studs. Referring first to FIG. 13, a concrete block infill 200 is built up between one corner stud 38 and an intermediate stud 40. Confronting channel openings define the space between each pair of the studs 38 and 40, or a pair of intermediate studs 40, said openings being sized to receive four inch concrete blocks 200, for example, which extend between the base webs of each adjacent pair of channel openings. Other types of masonary such as cinder blocks, bricks, etc. may be used. A cement render 202 may be applied to both the exterior and interior surfaces of the blocks 200. The exterior surfaces of the metal studs 38, 40 can be used as screeding bars in applying the cement render 202.

FIG. 14 illustrates a modified type of wall infill, between the adjacent pair of studs 38, 40, comprised of sandwich paneling 210 provided with a core 212 of expanded Polystyrene, for example, faced at 214 on both sides with asbestos cement, gypsum wallboard, sheet metal or particle board, by way of example.

FIG. 15 illustrates a further modified type of wall infill in which a slab of expanded Polystyrene 216 is inserted into small sheet metal channels 218 and 220 fixed as by welding along the insides of the back webs of the stud channels. The slab 216 may then be finished on the exterior and interior surfaces with a cement render in the manner described relative to FIG. 13.

Roof end eave extensions 220 may be provided from the respective end rafters 54, FIGS. 1 and 16, by connecting purlin extensions 222 to end rafters 54 and attaching facia channels 224 across the ends thereof. Extensions 220 are fixed to end rafters 54 by angle cleats in the same manners as the various purlin attachments to the rafters.

While the building construction of the present invention has been illustrated and described relative to a small residence, it may be equally applied to a substantial variety of different types and sizes of buildings.

What is claimed is:

1. A building construction comprising a reinforced concrete foundation and slab providing a top building support surface, a self-supporting skeletal building frame including outside wall and roof structure fixed to said slab on said support surface and having a predetermined length and width, and including a plurality of vertically extending exterior side wall studs spaced about the periphery of said slab, said studs being formed of a light gauge sheet metal material to define aligned confronting channel openings along the heights of each adjacent pair thereof, each of said studs having a lower end fixed to the slab and an upper end fixed to said roof structure, a plurality of roof rafters fixed in a spaced apart spanning relation to said skeletal frame width along said frame length and being formed of a light gauge sheet metal material to define aligned confronting channel openings along the lengths of each adjacent pair thereof, a plurality of spaced apart purlins fixed in a spanning relation between each adjacent pair of said roof rafters and being formed of a light gauge sheet metal material to define confronting channel openings along the lengths of each adjacent pair thereof;

said exterior studs include a corner stud at each corner of said wall assembly and at least one intermediate stud between each non-adjacent pair of said corner studs;

each of said intermediate studs being fabricated of a pair of alike sheet metal channel members, each channel member including a back web and a pair of outwardly extending side flanges, said pair of channel members being fixed together as by welding in a back-to-back relation to define a pair of oppositely opening channels;

each of said corner studs comprising a pair of alike back-to-back oppositely opening sheet metal channels, similar to said intermediate studs, and including a third alike channel member fixed thereto as by welding in a position to define a third channel opening substantially at 90 degrees to both of said pair of oppositely opening channels;

said building construction including an anchor plate fixed across the bottom end of each of said exterior studs, said anchor plate including through holes for engagement by conventional anchor bolts, preset in said concrete slab;

said building construction including an attachment plate fixed across the top end of each of said exterior studs, said attachment plate including through holes to provide for bolted engagement to said roof assembly;

said plurality of roof rafters comprising a pair of end rafters fixed respectively to opposed ends of said side wall assembly and at least one intermediate rafter therebetween, fixed to said wall assembly;

each of said end and intermediate rafters being fabricated of a pair of alike sheet metal channel members, each being comprised of a vertical back web and upper and lower side flanges, said pair of channel members being fixed together as by welding in a back-to-back relation to define a pair of oppositely outwardly opening channels;

said end and intermediate rafters each being formed of a pair of rafter lengths, angulated relative to each other to define a gable roof configuration with a central ridge line, each of said rafter lengths sloping downwardly and outwardly from said central ridge line to outer extended ends;

each of said rafter lengths including confronting ends along said central ridge line and including attachment plates, fixed to both of said confronting ends, with aligned through holes to provide for bolted together engagement of said pair of rafter lengths;

said plurality of purlins including a first plurality of aligned purlins fixed respectively between each adjacent pair of each rafter length adjacent said ridge line, a second plurality of aligned outer purlins, fixed respectively between each adjacent pair of each rafter length somewhat inwardly of said outer extended ends, and a third plurality of aligned intermediate purlins, fixed respectively between each adjacent pair of each rafter length between said first and second purlins;

each of said first plurality of purlins comprising an outwardly opening sheet metal channel member of a length to span the distance between said extending side flanges of said confronting channel openings of an adjacent pair of said roof rafter lengths, and including a generally angle shaped cleat fixed between each end of said first purlin and the respective rafters of said adjacent pair, each of said cleats including a stepped portion to provide a clearance for one of said confronting ends attachment plates.

2. The building construction as defined in claim 1 wherein each of said second plurality of purlins comprises an inwardly opening sheet metal channel member and including a generally angular cleat fixed between each end of each second purlin and the respective rafters of said adjacent pair.

3. The building construction as defined in claim 2 wherein each of said third plurality of purlins comprises a pair of channel members, fixed along their lengths in a back-to-back relation as by welding to define inwardly and outwardly opening channels in respective confronting relations to said outwardly and inwardly opening channels of said first and second purlins.

4. The building construction as defined in claim 3 wherein each of said channel members of said first, second and third pluralities of purlins includes a vertical back web and upper and lower side flanges, said purlin flanges in combination with said rafter upper and lower flanges defining upper and lower coplanar surfaces in assembly.

5. The building construction as defined in claim 4 including roof means fixed in a covering relation to said rafters and purlins over said upper surfaces.

6. The building construction as defined in claim 4 including a plurality of ceiling panels suspended on said purlin and rafter lower flanges within said rafter and purlin channels.

7. The building construction as defined in claim 6 including an H member suspended between each of said adjacent pairs of roof rafters on said lower flanges thereof, said H member being formed of a pair of fixed together back-to-back sheet metal channel members providing oppositely outwardly opening channels to receive and support edge portions of said ceiling panels intermediate said purlins.

8. The building construction as defined in claim 7 wherein said ceiling panels comprise conventional ceiling tiles.

9. The building construction as defined in claim 6 including H members suspended between each of said adjacent pairs of purlins on said lower flanges thereof, said H member being formed of a pair of fixed together back-to-back sheet metal channel members providing oppositely outwardly opening channels to receive and support edge portions of said ceiling panels intermediate said rafters.

* * * * *